US011118745B2

(12) United States Patent
Zheng et al.

(10) Patent No.: US 11,118,745 B2
(45) Date of Patent: Sep. 14, 2021

(54) STARRY PROJECTION LAMP

(71) Applicant: Shenzhen Skoe Technology Co., Ltd., Shenzhen (CN)

(72) Inventors: Caijian Zheng, Shenzhen (CN); Wenzhen Ouyang, Shenzhen (CN)

( * ) Notice: Subject to any disclaimer, the term of this patent is extended or adjusted under 35 U.S.C. 154(b) by 0 days.

(21) Appl. No.: 17/211,867

(22) Filed: Mar. 25, 2021

(65) Prior Publication Data

US 2021/0247039 A1 Aug. 12, 2021

(30) Foreign Application Priority Data

Feb. 25, 2021 (CN) ..... 202110215223.X

(51) Int. Cl.

| | |
|---|---|
| ***F21S 10/00*** | (2006.01) |
| ***F21V 5/04*** | (2006.01) |
| ***F21V 29/70*** | (2015.01) |
| ***F21V 14/08*** | (2006.01) |
| ***F21V 5/02*** | (2006.01) |
| *F21Y 115/10* | (2016.01) |
| *F21W 121/00* | (2006.01) |

(52) U.S. Cl.

CPC ..... *F21S 10/002* (2013.01); *F21S 10/007* (2013.01); *F21V 5/02* (2013.01); *F21V 5/04* (2013.01); *F21V 14/08* (2013.01); *F21V 29/70* (2015.01); *F21W 2121/008* (2013.01); *F21Y 2115/10* (2016.08)

(58) Field of Classification Search

CPC ..... F21S 10/00; F21S 10/007; F21S 6/002; F21V 33/0056; F21W 2121/008; F21W 2131/205; G09F 19/18; G03B 21/001

USPC ..... 353/62

See application file for complete search history.

(56) References Cited

U.S. PATENT DOCUMENTS

| | | | | |
|---|---|---|---|---|
| 4,591,955 | A * | 5/1986 | Kallay | F21S 10/00 362/101 |
| 4,779,176 | A * | 10/1988 | Bornhorst | G03B 15/02 353/62 |
| 5,902,032 | A * | 5/1999 | Hannigan | F21V 9/08 353/38 |
| 6,623,126 | B2 * | 9/2003 | Sekiguchi | G03B 21/14 353/23 |
| 7,857,454 | B2 * | 12/2010 | Mastrosimone-Gese | G03B 21/001 353/15 |
| 9,810,404 | B1 * | 11/2017 | Corey | F21V 14/006 |
| 10,830,410 | B1 * | 11/2020 | Wei | F21V 11/16 |
| 2013/0208479 | A1 * | 8/2013 | Allan | F21S 10/007 362/271 |
| 2014/0328085 | A1 * | 11/2014 | Johnson | F21V 13/02 362/644 |

(Continued)

*Primary Examiner* — Rajarshi Chakraborty
*Assistant Examiner* — Michael Chiang

(57) ABSTRACT

The present disclosure relates to a starry projection lamp, including a shell, a control panel arranged in the shell, a laser component, a water ripple component, and a film component. The lower part of the water ripple component is provided with a driving component which drives the water ripple component to move; the upper part, corresponding to the water ripple component, of an upper shell is provided with a lens outer cover; a lower shell is hemispheric; the lower part of the lower shell is also connected with a base; a power component is arranged inside the base; the upper part of the base is provided with a ring-like groove; and the shell is rotatably arranged on the ring-like groove of the base.

12 Claims, 3 Drawing Sheets

(56) References Cited

U.S. PATENT DOCUMENTS

| | | | | |
|---|---|---|---|---|
| 2015/0092418 | A1* | 4/2015 | Jurik | F21V 5/008 362/282 |
| 2015/0276178 | A1* | 10/2015 | Chien | F21V 23/0442 362/95 |
| 2017/0051887 | A1* | 2/2017 | Zeng | F21S 6/004 |
| 2019/0041028 | A1 | 2/2019 | Bremerich | |
| 2019/0226645 | A1 | 7/2019 | Chen | |
| 2021/0025582 | A1 | 1/2021 | Xie | |

* cited by examiner

STARRY PROJECTION LAMP

TECHNICAL FIELD

The present disclosure relates to a projection device, and in particular, a starry projection lamp.

BACKGROUND

Starry projection lamps are often used in some indoor places. By means of improvements on lamps, the lamps are used to directly project a starry environment to create an environment with stars. This is beneficial for people to relieve fatigue and stress caused by working for one day, and has a good decorative effect.

In the current industry, a projection lamp that combines water ripples and laser has a small water ripple projection area and a relatively regular movement, so that the projection effect is reduced; and this projection lamp easily causes people to have a visual fatigue.

SUMMARY

The technical problem to be solved in the present disclosure is to provide a starry projection lamp for the aforementioned defects in the prior art, so as to solve the defect that the starry projection lamp in the prior art has a monotonous projection effect.

The technical solution used by the present disclosure to solve the technical problems is: A starry projection lamp includes a shell, a control panel arranged in the shell, a laser component, a water ripple component, and a film component. The lower part of the water ripple component is provided with a driving component which drives the water ripple component to move; the shell includes a lower shell and an upper shell fastened on the lower shell; the upper part, corresponding to the water ripple component, of the upper shell is provided with a lens outer cover; the lower shell is hemispheric; the lower part of the lower shell is also connected with a base; a power component is arranged inside the base; the power component is electrically connected to the control panel; the upper part of the base is provided with a ring-like groove; and the shell is rotatably arranged on the ring-like groove of the base.

In one of the embodiments, a long-strip hole is formed in the lower shell; at least one group of stepped limiting grooves parallel to the long-strip hole are formed inside the lower shell; a fixing sheet is also arranged in the lower shell; a limiting bulge acting with the limiting grooves is arranged on the fixing sheet; and connecting pieces arranged on the long-strip hole in a penetrating manner and connected to the fixing sheet are arranged on the base.

In one of the embodiments, the connecting pieces are connecting pillars fixed on the base; fixing holes cooperating with and corresponding to the connecting pillars are correspondingly arranged on the fixing sheet; two connecting pillars and two corresponding fixing holes are provided respectively; and a first through hole used for threading is also arranged between the two fixing holes.

In one of the embodiments, two groups of limiting grooves are provided, and are respectively arranged on two sides of the long-strip hole; and the fixing sheet is correspondingly provided with two limiting bulges cooperating with the limiting grooves.

In one of the embodiments, the lower part of the base is provided with an anti-skid pad.

In one of the embodiments, the water ripple component includes an aluminum base plate, a water ripple sheet, and at least one LED light source uniformly distributed by taking a center of the aluminum base plate as a circle center; the driving component includes a motor, an output shaft and a motor cover; the output shaft is arranged on the aluminum base plate in a penetrating manner, and resists against the water ripple sheet; the driving component is arranged in the middle of the lower shell; the driving component drives the water ripple component to move; the motor and the water ripple component are arranged in the motor cover; and the top of the motor cover resists against the bottom of the lens outer cover.

In one of the embodiments, the laser component includes a laser device and a grating sheet arranged at the upper part of the laser device; a heat dissipater is arranged at a periphery of the laser component; and a first light outlet hole is arranged at a position, corresponding to the laser component, above the shell to allow light of the laser component to be emitted.

In one of the embodiments, the film component includes a white-light lamp panel, a projection seat, and a first optical lens, a film sheet, a film sheet pad and a projection seat cap which are arranged in the projection seat; the LED light sources are arranged on the white-light lamp panel; the projection seat is provided with a second through hole; the LED light sources pass through the second through hole; the first optical lens is arranged above the LED light sources; the film sheet is arranged above the first optical lens by means of the film sheet pad; a second light outlet hole is arranged at a position, corresponding to the film component, above the shell; and a second optical lens is arranged in the second light outlet hole.

In one of the embodiments, the appearance of the lens outer cover is of a semicircular sphere shape; an outer surface of the lens outer cover is a texture-free smooth surface; and an inner surface is formed by splicing a plurality of triangular lenses.

In one of the embodiments, a voice control module and a Wi-Fi intelligent module are also arranged on the control panel; a button component is arranged in the control panel; the button component is electrically connected to the control panel; and a voice receiving hole is formed in the shell.

The present disclosure has the beneficial effects that by means of the arrangement of the water ripple component, the laser component and the film component, a water ripple effect, a starry effect and a moon effect can be produced; furthermore, the water ripple component is rotatably disposed to cause imaged water ripples to reversely move, so that this water ripple effect is more irregular than the traditional water ripple effect; and the shell of the starry projection lamp is rotatably arranged on the base to cause the projection direction to be changeable, which greatly enhances the projection effect, brings a visual enjoyment to users, and makes the users get relaxed more easily.

BRIEF DESCRIPTION OF THE DRAWINGS

The present disclosure is further described below in combination with the accompanying drawings and embodiments. In the drawing.

Figure 1:
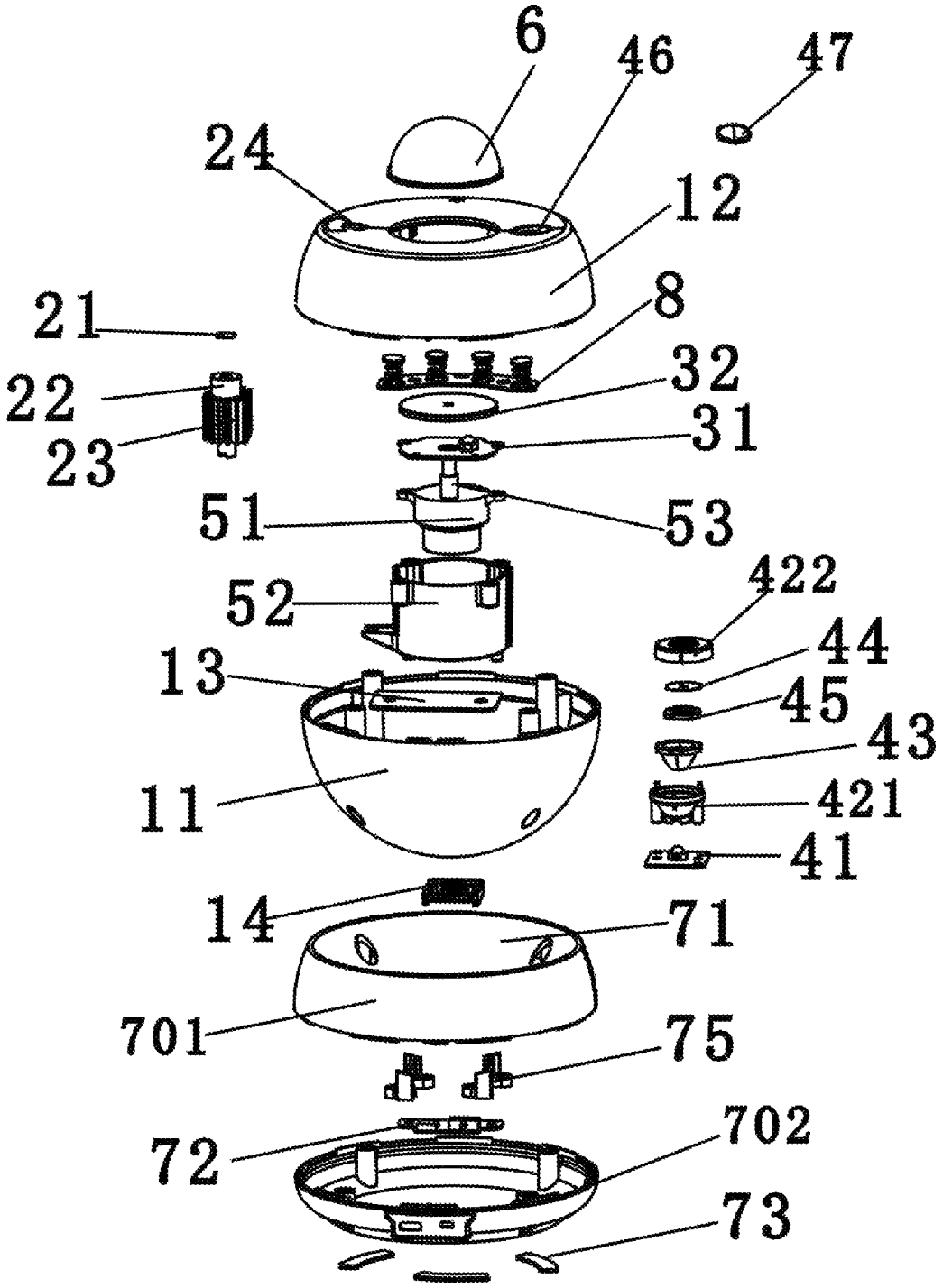
FIG. 1 is a schematic diagram of an exploded structure of a starry projection lamp of the present disclosure.

1: shell; 11: lower shell; 111: long-strip hole; 112: limiting groove; 12: upper shell; 13: control panel; 14: fixing sheet; 141: limiting bulge; 142: fixing hole; 2: laser component; 21: grating sheet; 22: laser device; 23: heat dissipater; 24: first light outlet hole; 3: water ripple component; 31: aluminum base plate; 32: water ripple sheet; 4: film component; 41: white-light lamp panel; 421: projection seat main body; 422: projection seat cap; 43: first optical lens; 44: film sheet; 45: film sheet pad; 46: second light outlet hole; 47: second optical lens; 5: driving component; 51: motor; 52: motor cover; 53: output shaft; 6: lens outer cover; 7: base; 701: base upper shell; 702: base lower shell; 71: ring-like groove; 72: power component; 73: anti-skid pad; 74: connecting piece; 75: fixed bracket; and 8: button component.

DESCRIPTION OF THE EMBODIMENTS

Now with reference to the drawings, the preferred embodiments of the present disclosure are described in detail.

As shown in FIG. 1 to FIG. 4, a starry projection lamp is provided, including a shell 1, a control panel 13 arranged in the shell 1, a laser component 2, a water ripple component 3, and a film component 4. The laser component 2 is used for achieving a star twinkling effect; the water ripple component 3 is used for achieving a water ripple effect; and the film component 4 is used for achieving a moon projection effect. The lower part of the water ripple component 3 is provided with a driving component 5 which drives the water ripple component 3 to move; the shell 1 includes a lower shell 11 and an upper shell 12 fastened on the lower shell 11; the upper part, corresponding to the water ripple component 3, of the upper shell 12 is provided with a lens outer cover 6; the lower shell 11 is hemispheric; the lower part of the lower shell 11 is also connected with a base 7; a power component 72 is arranged inside the base 7; the power component 72 is electrically connected to the control panel 13; the upper part of the base 7 is provided with a ring-like groove 71; and the shell 1 is rotatably arranged on the ring-like groove 71 of the base 7. By means of the arrangement of the water ripple component 3, the laser component 2 and the film component 4, a water ripple projection effect, a starry projection effect and a moon projection effect can be produced; furthermore, the water ripple component 3 is rotatably disposed to cause imaged water ripples to reversely move, so that this effect is more irregular than the traditional water ripple effect; and the shell 1 of the starry projection lamp is rotatably arranged on the base 7 to cause the projection direction to be changeable, which greatly enhances the projection effect, brings a visual enjoyment to users, and makes the users get relaxed more easily.

Figure 2:
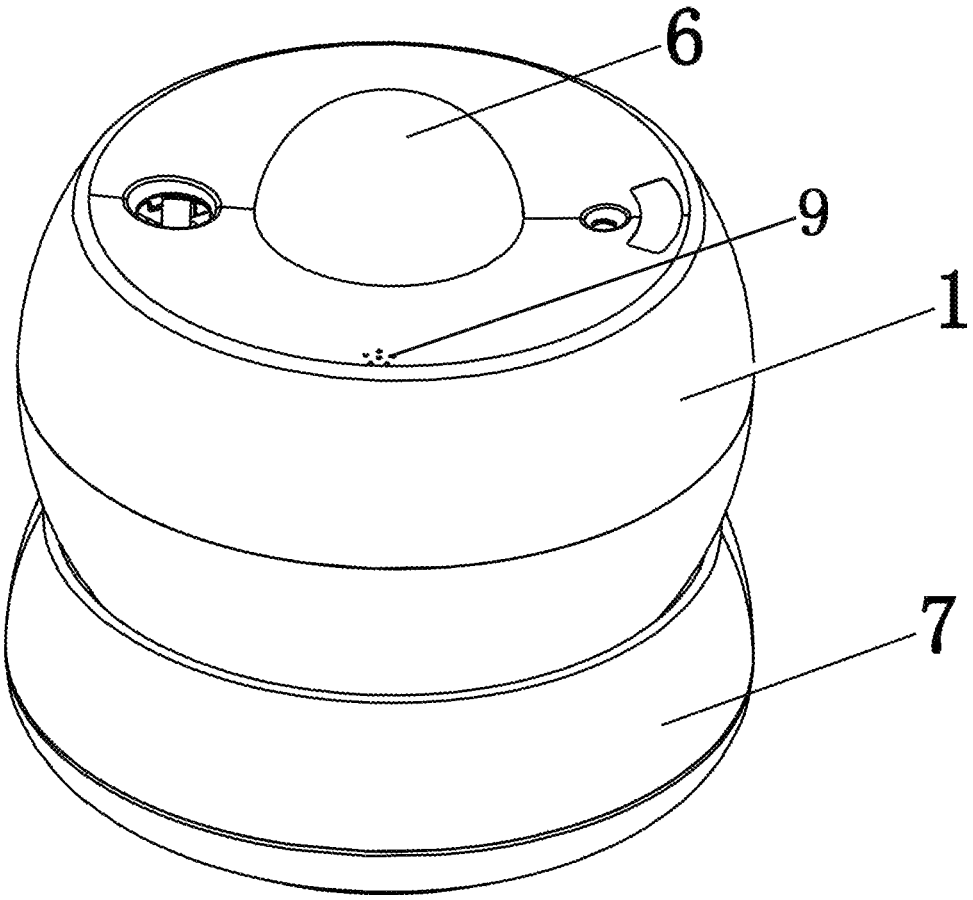
FIG. 2 is a schematic diagram of an entire structure of a starry projection lamp of the present disclosure.
Figure 3:
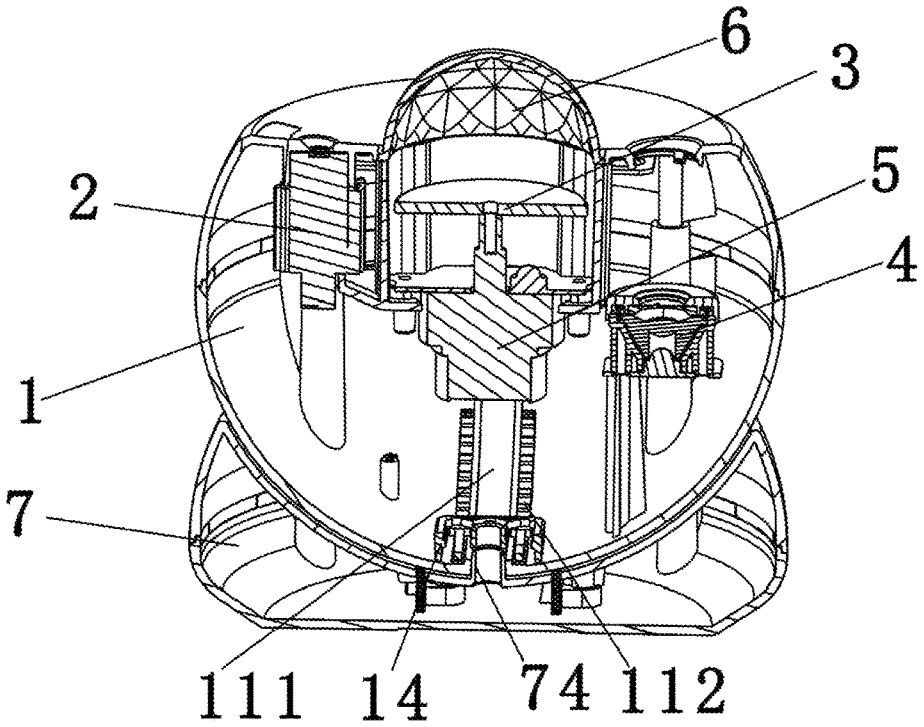
FIG. 3 is a schematic diagram of a half-sectional structure of the present invention.

In combination with FIG. 2 and FIG. 3, the lower shell 11 is hemispheric, and the lower shell 11 has an accommodating cavity. The upper shell 12 is fastened on the lower shell 11, and can be conveniently taken down to replace a pattern of a component inside to form different projection shapes. The base 7 is internally provided with the power component 72. The base 7 includes a base upper shell 701 and a base lower shell 702; the base upper shell 701 and the base lower shell 702 are connected by means of a fixed bracket 75; the lower part of the base 7 is provided with an anti-skid pad 73 to ensure stable placement of the base 7 on a placement plane.

Figure 4:
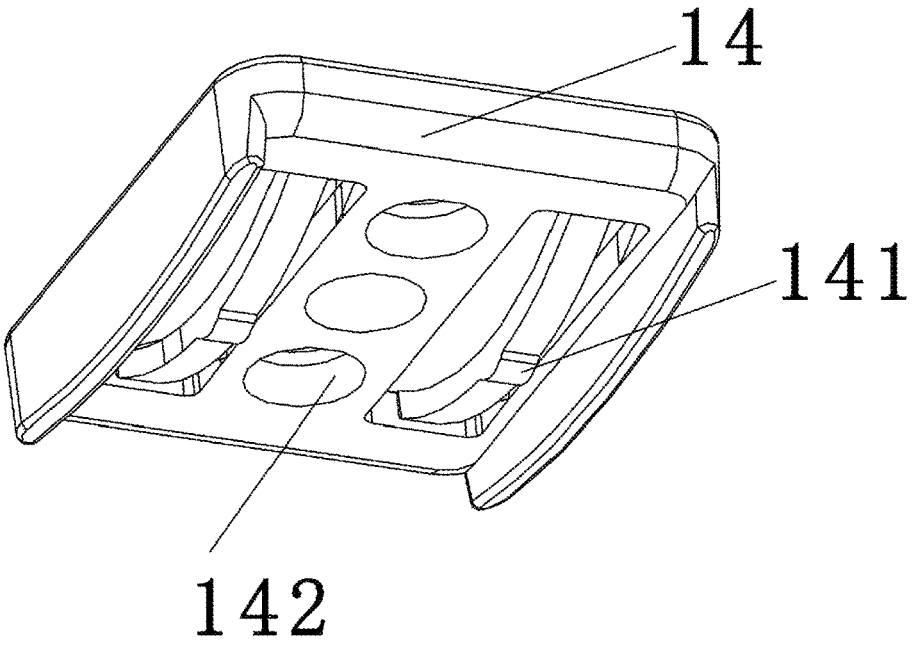
FIG. 4 is a schematic structural diagram of a fixing sheet of the present disclosure.

In further combination with FIG. 4, in the present embodiment, a long-strip hole 111 is formed in the bottom of the lower shell 11; at least one group of stepped limiting grooves 112 parallel to the long-strip hole 111 are formed inside the accommodating cavity of the lower shell 11; a fixing sheet 14 is also arranged in the accommodating cavity of the lower shell 11; a limiting bulge 141 acting with the limiting grooves 112 is arranged on the fixing sheet 14; and a connecting piece 74 arranged on the long-strip hole 111 in a penetrating manner and connected to the fixing sheet 14 is arranged on the base 7. The base 7 and the shell 1 are connected by means of the action of the connecting piece 74, and rotation of the shell 1 on the base 7 is realized by means of the action of the limiting bulge 141 and the stepped limiting grooves 112 to realize angle adjustment for the shell 1.

Further, in the present embodiment, the connecting piece 74 is a connecting pillar fixed on the base 7. A peripheral size of the connecting pillar is less than the width of the long-strip hole 111 to ensure that the connecting pillar can move in the long-strip hole 111 along with the rotation of the fixing sheet 14. A fixing hole 142 cooperating with and corresponding to the connecting pillar is correspondingly arranged on the fixing sheet 14. Connection between the base 7 and the shell 1 is realized by means of cooperation between the connecting pillar and the fixing hole 142. There are two connecting pillars and two corresponding fixing holes 142, respectively. The fixing holes 142 may be screw fixing holes, so the connecting piece and the fixing sheet 14 are connected by means of screws. Or, each connecting pillar may be set to have a certain taper, with a smaller upper end. The connecting pillars are nested in the fixing holes 142, and a firm connection between the connecting pillars and the fixing sheet 14 is realized by means of interference fit. The two connecting pillars are disposed front and back along the long-strip hole 111. In the present embodiment, a first through hole is also arranged between the two fixing holes 142. The first through hole is used for threading a starry projection lamp wire.

In the present disclosure, there are two groups of limiting grooves 112 respectively arranged on two sides of the long-strip hole 111. The fixing sheet 14 is correspondingly provided with two limiting bulges 141 cooperating with the limiting grooves 112. When the shell 1 is rotated along a specified direction, the limiting bulges 141 move on the limiting grooves 112, and cooperate with the corresponding limiting grooves 112 to fix the shell 1.

The water ripple component 3, the laser component 2 and the film component 4 are all arranged inside the shell 1, and are electrically connected to the control panel 13, respectively. The control panel 13 is connected to the power component 72 in the base 7.

Specifically, the water ripple component 3 includes an aluminum base plate 31, a water ripple sheet 32, and at least one LED light source uniformly distributed by taking a center of the aluminum base plate 31 as a circle center. The driving component 5 is arranged in the middle of the lower shell 11. The driving component 5 includes a motor 51, an output shaft 53 and a motor cover 52. The motor 51 and the water ripple component 3 are arranged in the motor cover 52. The aluminum base plate 31 facilitates heat dissipation of the water ripple component 3. The output shaft 53 is arranged on the aluminum base plate 31 in a penetrating manner, and resists against the water ripple sheet 32. The top of the motor cover 52 resists against the bottom of the lens outer cover 6 to ensure that the whole water ripple component 3 has a compact overall structure and can be effectively aligned with the lens outer cover 6.

The appearance of the lens outer cover 6 is of a semicircular sphere shape; an outer surface of the lens outer cover 6 is a texture-free smooth surface; and an inner surface is formed by splicing a plurality of triangular lenses. The lens outer cover 6 that is formed by splicing the plurality of triangular lenses has an amplification effect on light, and can meet an effect of refracting and amplifying a water ripple light pattern to form a large-area exceptional and colourful water ripple light pattern effect.

Under the action of the driving component 5 and the lens outer cover 6, the water ripple component 3 achieves a large-area rotational water ripple water pattern effect, which brings a fantastic visual enjoyment to people.

The laser component 2 includes a laser device 22 and a grating sheet 21 arranged at the upper part of the laser device 22. An illuminated surface of the grating sheet 21 faces a light-emitting surface of the laser device 22. A first light outlet hole 24 is arranged at a corresponding position of the upper shell 12 to allow light of the laser component 2 to be emitted. The grating piece 21 is a starry pattern; laser emitted by the laser device 22 is refracted by the starry pattern grating sheet 21 to form starry light; the starry light is projected to the outside through light outlets to create static starry light atmosphere, which greatly enhances the visual experience of a user and makes the user pleasant. A heat dissipater is also arranged at a periphery of the laser component 2, and is used for dissipating heat of the laser component 2.

The film component 4 is used for providing a moon-like light pattern, and includes a white-light lamp panel 41, a projection seat, and a first optical lens 43 and a film sheet 44 which are arranged in the projection seat. The projection seat includes a projection seat main body 421 and a projection seat cap 422; and the first optical lens 43, the film sheet 44 and a film sheet pad 45 are all arranged in a cavity formed by the projection seat cap 422. A white-light light source is arranged on the white-light lamp panel 41; the bottom of the projection seat main body 421 is provided with a second through hole; the white-light light source passes through the second through hole; the first optical lens 43 is used for focusing the white-light light source to enable the light to irradiate the film sheet 44; the first optical lens 43 is arranged above the LED light sources; and the film sheet 44 is arranged above the first optical lens 43 by means of the film sheet pad 45. In the present embodiment, the film sheet 44 provides a moon light pattern. A second light outlet hole 46 is arranged on the shell to allow light of the film component 4 to be emitted. The second light outlet hole 46 is located right above the film component 4. A second optical lens 47 is arranged inside the second light outlet hole 46 and used for focusing of the film sheet 44 to ensure that a moon pattern is displayed clearly and completely.

In the present embodiment, a voice control module and a Wi-Fi module are arranged on the control panel 13; a button component 8 is also arranged in the shell 1; the button component 8 is electrically connected to the control panel 13; and a voice receiving hole 9 is also formed in the shell 1. Wireless communication between the control panel 13 and a mobile phone or an intelligent sound box and the like can be realized by means of the Wi-Fi module, and functions such as controlling on/off states and light effects of light to be switched, remotely and regularly controlling a working state of the starry projection lamp, and remotely wirelessly adjusting the brightness of the light can be realized by means of a mobile phone APP. The voice receiving hole 9 is used to receive external music or voices; the voice control module controls the light of the starry projection lamp to correspondingly flicker with the rhythm of music; and the button component may include keys having functions of light switch, light scene mode, light brightness, and the like.

The starry projection lamp of the present disclosure has a rotational projection direction, has the starry, moon and rotational water ripple effects, and brings a visual enjoyment to the user.

It should be noted that the terms "perpendicular", "horizontal", "coaxial", "left" and similar expressions used herein are for illustrative purposes only, and are not meant to be the only implementation modes.

All the technical features of the embodiments described above can be arbitrarily combined. In order to simplify the description, all possible combinations of the technical features in the above embodiments have not been described. However, the combinations of these technical features should be considered as the scope described in this description as long as there is no contradiction in them.

It should be understood that the above embodiments are only used to illustrate the technical solutions of the present disclosure, not to limit them. Those skilled in the art can make modifications to the technical solutions in the embodiments described above, or make equivalent replacements to partial technical features; and these modifications and replacements shall all fall within the protection scope of claims appended of the present disclosure.

What is claimed is:

1. A starry projection lamp, comprising a shell, a control panel arranged in the shell, a laser component, a water ripple component, and a film component, wherein the lower part of the water ripple component is provided with a driving component which drives the water ripple component to move, the shell comprises a lower shell and an upper shell fastened on the lower shell; an upper part of the upper shell, wherein the upper part corresponds to the water ripple component, and the upper part is provided with a lens outer cover, the lower shell is hemispheric, the lower part of the lower shell is also connected with a base; a power component is arranged inside the base; the power component is electrically connected to the control panel; the upper part of the base is provided with a ring-like groove; and the shell is rotatably arranged on the ring-like groove of the base; a long-strip hole is formed in the lower shell; at least one group of stepped limiting grooves parallel to the long-strip hole are formed inside the lower shell; a fixing sheet is also arranged in the lower shell; a limiting bulge acting with the limiting grooves is arranged on the fixing sheet and connecting pieces arranged on the long-strip hole in a penetrating manner and connected to the fixing sheet are arranged on the base.

2. The starry projection lamp according to claim 1, wherein the connecting pieces are connecting pillars fixed on the base; fixing holes cooperating with and corresponding to the connecting pillars are correspondingly arranged on the fixing sheet; two connecting pillars and two corresponding fixing holes are provided, respectively, and a first through hole used for threading is also arranged between the two fixing holes.

3. The starry projection lamp according to claim 2, wherein two groups of limiting grooves are provided; the two groups of limiting grooves are respectively arranged on two sides of the long-strip hole; and the fixing sheet is correspondingly provided with two limiting bulges cooperating with the limiting grooves.

4. The starry projection lamp according to claim 3, wherein a lower part of the base is provided with an anti-skid pad.

5. The starry projection lamp according to claim 4, wherein the appearance of the lens outer cover is of a semicircular sphere shape; an outer surface of the lens outer cover is a texture-free smooth surface; and an inner surface is formed by splicing a plurality of triangular lenses.

6. The starry projection lamp according to claim 5, wherein a voice control module and a Wi-Fi intelligent module are also arranged on the control panel; a button component is arranged in the control panel; the button component is electrically connected to the control panel; and a voice receiving hole is formed in the shell.

7. The starry projection lamp according to claim 1, wherein the water ripple component comprises an aluminum base plate, a water ripple sheet, and at least one LED light source uniformly distributed by taking a center of the aluminum base plate as a circle center, the driving component comprises a motor, an output shaft and a motor cover, the output shaft is arranged on the aluminum base plate in a penetrating manner, and resists against the water ripple sheet; the driving component is arranged in the middle of the lower shell; the driving component drives the water ripple component to move; the motor and the water ripple component are arranged in the motor cover, and the top of the motor cover resists against the bottom of the lens outer cover.

8. The starry projection lamp according to claim 7, wherein the appearance of the lens outer cover is of a semicircular sphere shape; an outer surface of the lens outer cover is a texture-free smooth surface; and an inner surface is formed by splicing a plurality of triangular lenses.

9. The starry projection lamp according to claim 1, wherein the laser component comprises a laser device and a grating sheet arranged at the upper part of the laser device, a heat dissipater is arranged at a periphery of the laser component; and a first light outlet hole is arranged at a position, corresponding to the laser component, above the shell to allow light of the laser component to be emitted.

10. The starry projection lamp according to claim 9, wherein the appearance of the lens outer cover is of a semicircular sphere shape; an outer surface of the lens outer cover is a texture-free smooth surface; and an inner surface is formed by splicing a plurality of triangular lenses.

11. The starry projection lamp according to claim 1, wherein the film component comprises a white-light lamp panel, a projection seat, and a first optical lens, a film sheet and a film sheet pad which are arranged in the projection seat, LED light sources are arranged on the whit-light lamp panel; the projection seat is provided with a second through hole; the LED light sources pass through the second through hole; the first optical lens is arranged above the LED light sources, the film sheet is arranged above the first optical lens by means of the film sheet pad; a second light outlet hole is arranged at a position, corresponding to the film component, above the shell; and a second optical lens is arranged in the second light outlet hole.

12. The starry projection lamp according to claim 11, wherein the appearance of the lens outer cover is of a semicircular sphere shape; an outer surface of the lens outer cover is a texture-free smooth surface; and an inner surface is formed by splicing a plurality of triangular lenses.

* * * * *